United States Patent [19]

Gaia et al.

[11] 4,058,786

[45] Nov. 15, 1977

[54] PROTECTOR FOR ELECTRIC CIRCUITS

[75] Inventors: Aldino J. Gaia; Angelo Urani, both of St. Louis, Mo.

[73] Assignee: McGraw-Edison Company, Elgin, Ill.

[21] Appl. No.: 632,621

[22] Filed: Nov. 17, 1975

[51] Int. Cl.[2] ..... H01H 85/04

[52] U.S. Cl. ..... 337/293; 337/161

[58] Field of Search ..... 337/293, 161, 162, 274, 337/229

[56] References Cited

U.S. PATENT DOCUMENTS

| | | | |
|---|---|---|---|
| 3,253,104 | 5/1966 | Fister | 337/274 |
| 3,735,317 | 5/1973 | Jacobs | 337/161 |

*Primary Examiner*—Harold Broome

*Attorney, Agent, or Firm*—Jon Carl Gealow; Thomas E. McDonald; Ronald J. LaPorte

[57] ABSTRACT

The dual element fuse of the present invention has at least one fusible element and at least one mass of heat softenable material; and that fusible element will respond to a short circuit to fuse and thereby assure opening of the circuit, whereas that mass of heat softenable material will respond to a long-continued relatively-low potentially-hurtful overcurrent to soften and thereby initiate opening of the circuit. That dual element fuse has a shunt element which shunts the mass of heat softenable material and which will fuse after that mass of heat softenable material has initiated opening of the circuit. That shunt element has a current rating which is larger than the current rating of the mass of heat softenable material; and that shunt element has a current-interrupting characteristic which has the same shape as that of the current-interrupting characteristic of the fusible element.

15 Claims, 10 Drawing Figures

FIG. 1.
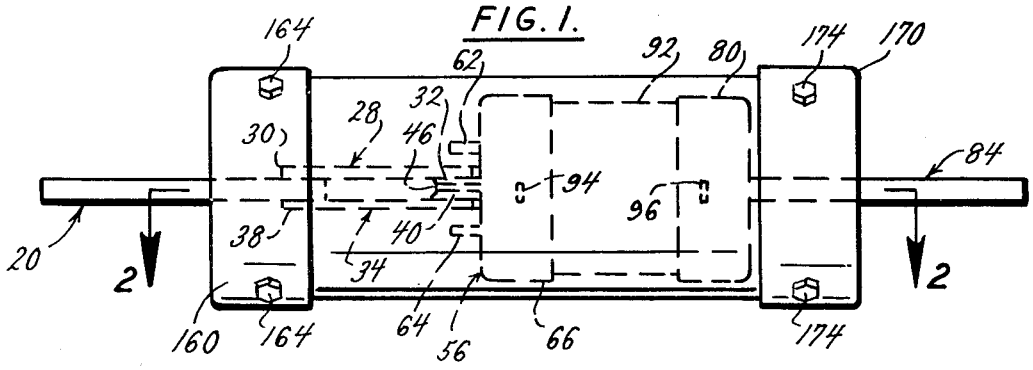
FIG. 5.
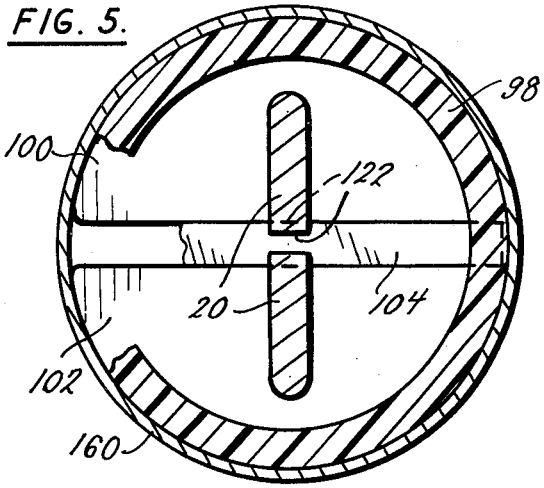
FIG. 6.
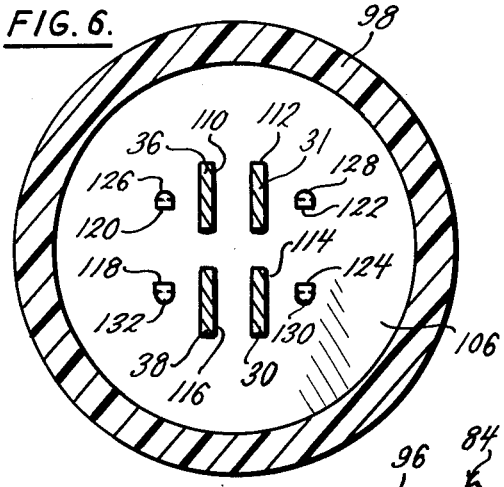
FIG. 7.
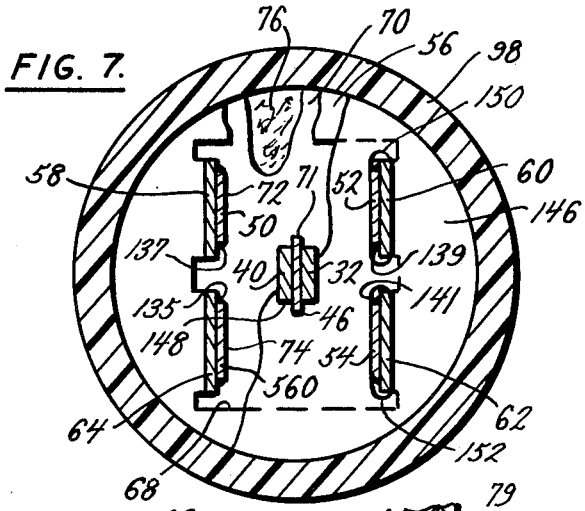
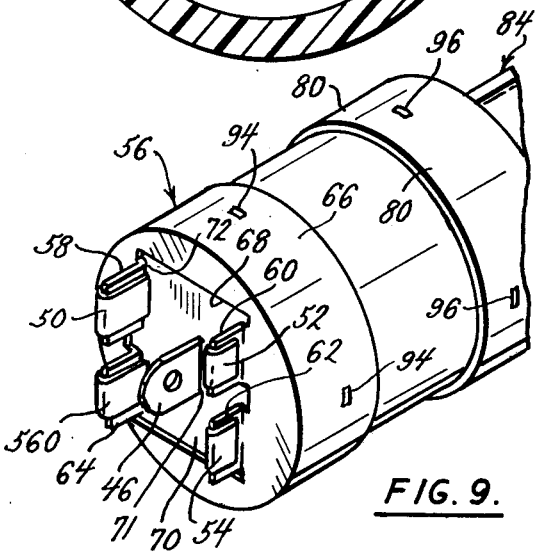
FIG. 9.
FIG. 8.
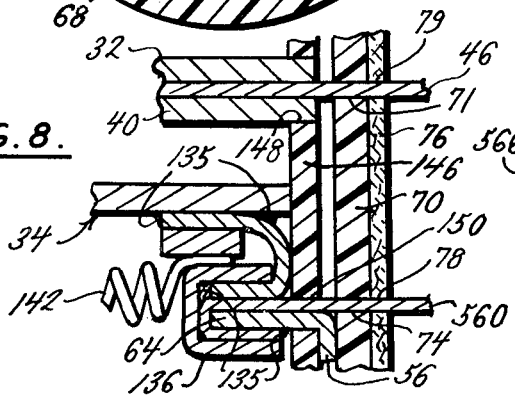
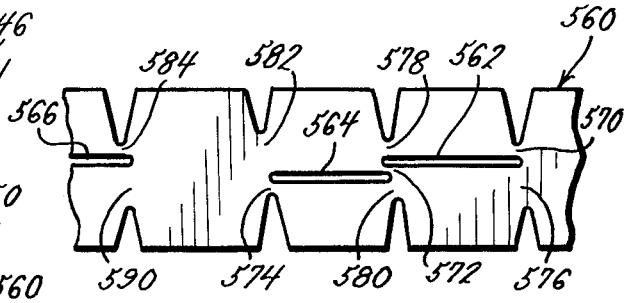
FIG. 10.

PROTECTOR FOR ELECTRIC CIRCUITS

FIELD OF THE INVENTION

This invention relates to dual element fuses. More particularly, this invention relates to dual element fuses which have shunt elements therein.

DESCRIPTION OF THE PRIOR ART

A true dual element fuse has at least one fusible element and at least one mass of heat softenable material. Many prior dual element fuses, such as the dual element fuse of Fister U.S. Pat. No. 3,122,619 which was granted Feb. 25, 1964, have had shunt elements which shunted the masses of heat softenable material. Those shunt elements opened the circuits after the masses of heat softenable material softened in response to long-continued relatively-low potentially-hurtful overcurrents, and those shunt elements coacted with the fusible elements to open the circuits in response to short circuits; but the shapes of the current-interrupting characteristics of those shunt elements were not similar to those of the current-interrupting characteristics of those fusible elements.

SUMMARY OF THE INVENTION

The dual element fuse of the present invention has at least one fusible element and at least one mass of heat softenable material; and that fusible element will respond to a short circuit to open the circuit, whereas the mass of heat softenable material will respond to a long-continued relatively-low potentially-hurtful overcurrent to open the circuit. That dual element fuse has a shunt element which shunts the mass of heat softenable material, and will thereby minimize arcing as that mass of heat softenable material initiates opening of the circuit. That shunt element has a current rating which is larger than the current rating of the mass of heat softenable material; and that shunt element has a current-interrupting characteristic which has the same shape as that of the current-interrupting characteristic of the fusible element. It is, therefore, an object of the present invention to provide a dual element fuse which has a least one fusible element and at least one mass of heat softenable material, and which has a shunt element that has a current-interrupting characteristic which has the same shape as that of the current-interrupting characteristic of the fusible element.

Where the dual element fuse of the present invention has a plurality of fusible elements and a plurality of masses of heat softenable material, a connecting ring electrically interconnects one end of each of those fusible elements. In doing so, that connecting ring keeps any higher-than-normal-electrical-resistance connection between one of those fusible elements and an adjacent heat absorber from generating so much heat that it initiates premature softening of the mass of heat softenable material which is a part thereof. It is, therefore, an object of the present invention to provide a dual element fuse which has a plurality of fusible elements, a plurality of masses of heat softenable material, and a connecting ring which electrically interconnects one end of each of those fusible elements.

Other and further objects and advantages of the present invention should become apparent from an examination of the drawing and accompanying description.

In the drawing and accompanying description, a preferred embodiment of the present invention is shown and described, but it is to be understood that the drawing and accompanying description are for the purpose of illustration only and do not limit the invention and that the invention will be defined by the appended claims.

BRIEF DESCRIPTION OF THE DRAWING

Referring to the drawing in hereof,

FIG. 1 is a side elevational view of one preferred embodiment of dual element fuse that is made in accordance with the principles and teachings of the present invention, FIG. 5 is yet another sectional view, on the scale of FIG. 2, and it is taken along the plane indicated by the line 5—5 in FIG. 2, FIG. 6 is a further sectional view, on the scale of FIG. 2, and it is taken along the plane indicated by the line 6—6 in FIG. 2, FIG. 7 is a partially broken-away sectional view, on the scale of FIG. 2, and it is taken along the plane indicated by the line 7—7 in FIG. 2, FIG. 8 is a sectional view, on a still larger scale, through the dual element fuse of FIG. 1, and it is taken along the plane indicated by the line 8—8 in FIG. 2, FIG. 9 is a perspective view of part of a subassembly for the dual element fuse of FIG. 1, and FIG. 10 is a plan view, on an even larger scale, of a portion of the length of one of the fusible elements of the dual element fuse of FIG. 1.

DETAILED DESCRIPTION OF THE PREFERRED EMBODIMENT

Figure 2:
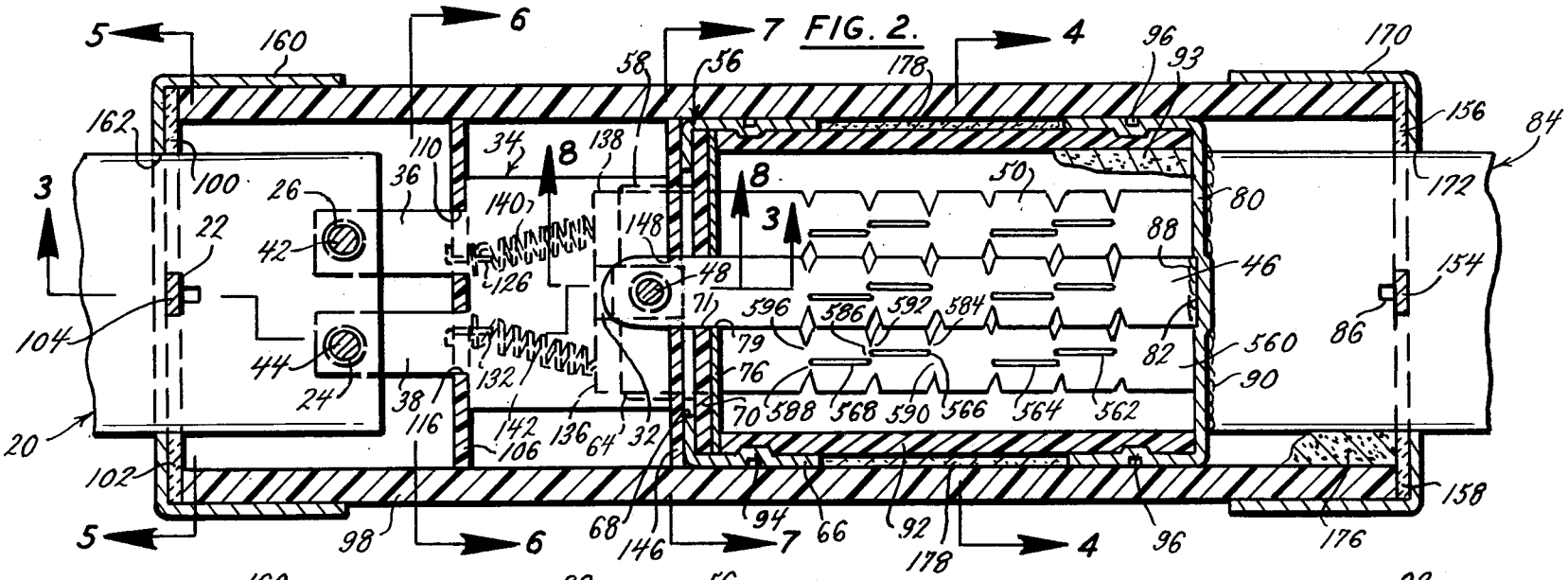
FIG. 2 is a sectional view, on a larger scale, through the dual element fuse of FIG. 1, and it is taken along the plane indicated by the line 2—2 in FIG. 1.
Figure 4:
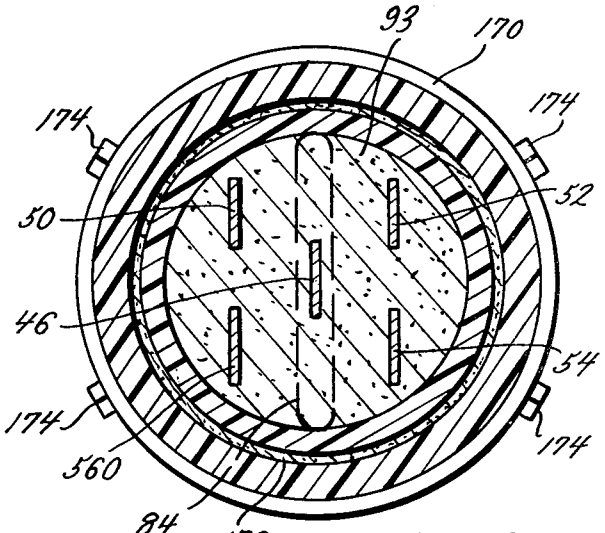
FIG. 4 is another sectional view, on the scale of FIG. 2, and it is taken along the plane indicated by the line 4—4 in FIG. 2.

Referring to the drawing in detail, the numeral 20 generally denotes a blade-type terminal of one preferred embodiment of dual element fuse which is made in accordance with the principles and teachings of the present invention; and that terminal preferably is made of copper. A T-shaped opening 22 is formed in that terminal, as indicated particularly by FIG. 2; and openings 24 and 26 are formed in that terminal adjacent the inner end thereof, as indicated particularly by FIGS. 2 and 3. That terminal is rectangular in plan view and in longitudinal section, but it has rounded edges in end view.

Figure 3:
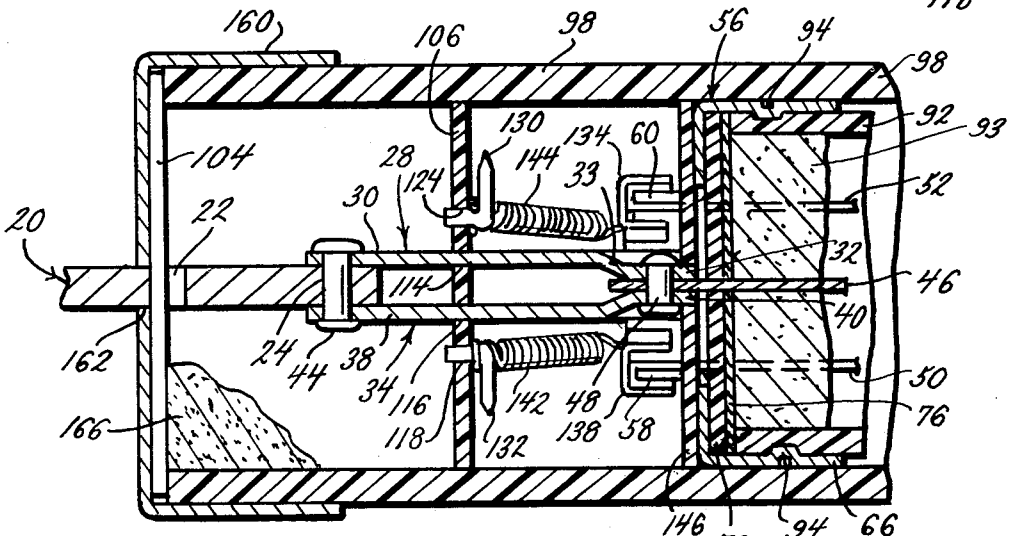
FIG. 3 is a sectional view, on the scale of FIG. 2, and it is taken along the broken plane indicated by the broken line 3—3 in FIG. 2.

The numeral 28 generally denotes a heat absorber which has narrow, spaced-apart projections 30 and 31 extending from the left-hand end thereof, as indicated by FIGS. 1, 3 and 6; and that heat absorber preferably is made of copper. Those projections overlie the right-hand end of the terminal 20; and they have openings therein which are aligned with the openings 24 and 26 in that terminal. The opening in the projection 30 is aligned with the opening 24 in the terminal 20, as shown particularly by FIG. 3. An offset 32, which is essentially rectangular in plan view, is displaced below the plane of the heat absorber 28 by an inclined portion 33, as shown by FIG. 3. That offset is in register with the longitudinal center line of the heat absorber 28; and the right-hand end of that offset extends to the right beyond the rest of the right-hand edge of that heat absorber.

The numeral 34 generally denotes a heat absorber which is identical to the heat absorber 28. However, the heat absorber 34 is oriented so the offset 40 hereof is disposed above, rather than below, the plane thereof, as shown by FIG. 3. Projections 36 and 38 of the heat absorber 34 are disposed below, rather than above, the terminal 20, as indicated by FIG. 3. Openings in the projections 36 and 38 are aligned with the openings 26 and 24 in the terminal 20; and the opening in the projection 38 is aligned with the opening 24, as shown by FIG. 3.

A rivet 42 is disposed within the aligned openings of the projections 31 and 36 and the opening 26 of the terminal 20; and a rivet 44 is disposed within the aligned openings of the projections 30 and 38 and the opening 24 in that terminal. Those rivets fixedly secure the heat absorbers 28 and 34 to the terminal 20; and high melting temperature solder, not shown, is applied to the joints between those rivets and those projections. As a result, low resistance electrical connections are provided between the terminal 20 and the heat absorbers 28 and 34. The rivets 42 and 44 coact with the terminal 20 to tend to hold the confronting faces of the offsets 32 and 40 of the heat absorbers 28 and 34 in confronting relation and spaced apart just a few thousandths of an inch.

The numeral 46 denotes a shunt element which preferably is made of copper and which has a number of longitudinally-extending slots therein and a number of notches in the edges thereof that coact to define a plurality of longitudinally-spaced weak spots for that shunt element. The left-hand end of that shunt element is disposed between the confronting faces of the offsets 32 and 40, as indicated particularly by FIGS. 2 and 3. A rivet 48 is disposed within aligned openings in those offsets and in that shunt element to fixedly secure that shunt element to the heat absorbers 28 and 34. High melting temperature solder, not shown, is applied to the joints between the shunt element 46 and the offsets 32 and 40 to provide low resistance electrical connections between that shunt element and the heat absorbers 28 and 34.

The numerals 50, 52, 54 and 560 denote fusible elements that preferably are made of copper; and each of them has a number of longitudinally-extending slots therein and a number of notches in the edges thereof that coact to define a plurality of longitudinally-spaced weak spots for that fusible element. The left-hand ends of those fusible elements are coextensive with, but are spaced away from, the portions of the heat absorbers 28 and 34 that are disposed at opposite sides of the offsets 32 and 40 of those heat absorbers. Those fusible elements are substantially coextensive with, but are spaced away from, the shunt element 46. The longitudinally-extending slots and the notches in each fusible element preferably are identical to the corresponding longitudinally-extending slots and to the notches in the shunt element, so the weak spots of those fusible elements and the weak spots of that shunt element have the same locations and configurations. However, each of those fusible elements is thicker than that shunt element.

The numeral 56 generally denotes a connecting ring which preferably is made of copper and which has a planar wall and a cylindrical portion 66. Four flat, rectangular projections 58, 60, 62 and 64 are punched and bent outwardly from the planar wall of that connecting ring, as indicated particularly by FIG. 9. At the time those projections are punched and bent outwardly from that planar wall, other portions of that planar wall are punched out to define a large, generally-rectangular opening 68, as shown by FIG. 9.

The numeral 70 denotes a circular disk of insulating material, such as vulcanized fiber, which has rectangular openings 72 and 74 therein, as shown by FIG. 7, to accommodate the ends of the fusible elements 50 and 560. That disk has a rectangular opening 71 to accommodate the end of the shunt element 46, as shown by FIGS. 2, 3, 7 and 9; and it has two further rectangular openings, not shown, to accommodate the ends of the fusible elements 52 and 54. The disk 70 is dimensioned to fit snugly within the cylindrical portion 66 of the connecting ring 56, as shown by FIGS. 2 and 3.

The numeral 76 denotes a disk of insulating material, such as asbestos, which has a rectangular opening 78 therein, as shown by FIG. 8, to accommodate the left-hand end of the fusible element 560. That disk has three further rectangular openings, not shown, which accommodate the left-hand ends of the fusible elements 50, 52 and 54. In addition, the disk 76 has a rectangular opening 79 to accommodate the left-hand end of the shunt 46, as shown by FIGS. 3 and 8.

The numeral 80 denotes a ferrule-like closure which preferably is made of copper and which has five coined sockets 82 therein, as indicated by FIG. 2. Those coined sockets are dimensioned to accommodate the right-hand ends of the fusible elements 50, 52, 54 and 560 and of the shunt element 46. A blade-type terminal 84, which preferably is of copper, is fixedly secured to the planar wall of the ferrule-like closure 80 by high temperature solder 90. That blade-type terminal has a T-shaped opening 86 therein, as indicated by FIG. 2. High-temperature solder 88 is used to mechanically secure and electrically bond the right-hand ends of the fusible element 50, 52, 54 and 560 and of the shunt element 46 to the planar wall of the ferrule-like closure 80.

The numeral 92 denotes a tubular casing of insulating material, such as vulcanized fiber, which telescopes within the cylindrical portion 66 of the connecting ring 56 and within the cylindrical portion of the ferrule-like closure 80. That tubular casing coacts with the connecting ring 56, with the disks 70 and 76, and with the ferrule-like closure 80 to enclose the major portions of the lengths of the fusible element 50, 52, 54 and 560 and of the shunt element 46. Arc-quenching filler material 93, such as quartz sand, is disposed within the tubular casing 92 in intimate engagement with the fusible elements 50, 52, 54 and 560 and with the shunt element 46.

Four point-like areas 94 of the cylindrical portion 66 of the connecting ring 56 are staked into holding engagement with the left-hand end of the tubular casing 92; and four point-like areas 96 of the cylindrical portion of the ferrule-like closure 80 are staked into holding engagement with the right-hand end of that tubular casing. As a result, the shunt element 46, the fusible elements 50, 52 and 54 and 560, the connecting ring 56, the disk 70, the disk 76, the ferrule-like closure 80, the tubular casing 92, and the arc-extinguishing filler 93 constitute a sub-assembly which can be assembled and tested independently of the rest of the dual element fuse. The left-hand end of the shunt element 46 and the left-hand ends of the fusible elements 50, 52, 54 and 560 pass through the appropriate openings in the disks 76 and 70, and also pass through the generally-rectangular opening 68 in the planar wall of the connecting ring 56. The left-hand ends of those fusible elements are bent into intimate engagement with the left-hand ends and with the wide faces of the projections 58, 60, 62 and 64 on the connecting ring 56, as indicated by FIGS. 3 and 9.

The numeral 98 denotes a tubular casing of insulating material, such as vulcanized fiber. The inner diameter of the tubular casing 98 is large enough to permit the connecting ring 56 and the ferrule-like closure 80 to telescope within that tubular casing; but the inner diameter of that tubular casing is small enough to assure contact between the inner surface of that tubular casing and appreciable areas of the outer surface of the cylindrical portion 66 of that connecting ring and appreciable areas of the cylindrical portion of that ferrule-like closure.

Semi-circular disks 100 and 102 of insulating material, such as asbestos, have notches therein to accommodate the side edges of the terminal 20, as indicated by FIGS. 2 and 5. The confronting edges of those semicircular disks are spaced apart to accommodate an elongated pin 104 of rectangular cross section which extends through the opening 22 in the terminal 20. The ends of that elongated pin abut the left-hand end of the tubular casing 98, as shown by FIG. 3.

The numeral 106 denotes a circular disk of insulating material, such as vulcanized fiber, which is dimensioned to fit snugly within the tubular casing 98. That disk has four rectangular openings 110, 112, 114 and 116 therein, as shown by FIG. 6. The openings 110 and 116 of that disk are dimensioned to accommodate the projections 36 and 38 of the heat absorber 34; and the openings 112 and 114 of that disk are dimensioned to accommodate the projections 31 and 30 of the heat absorber 28. The openings 110, 112, 114 and 116 are, respectively, telescoped over the projections 36, 31, 30 and 38 prior to the time those projections are riveted to the terminal 20. The disk 106 also has four smaller rectangular openings 118, 120, 122 and 124 therein, as indicated by FIG. 6. Hooks 126, 128, 130 and 132 are fixedly mounted within the openings 120, 122, 124 and 118, respectively. As indicated particularly by FIGS. 2 and 3, those hooks extend to the right from the disk 106.

The numeral 134 denotes an S-shaped connector which normally has a portion thereof telescoped over the left-hand end of the fusible element 52; and the numerals 138 and 136 denote further S-shaped connectors which normally have portions thereof telescoped over the lefthand ends of the fusible elements 50 and 560. A fourth S-shaped connector, not shown, normally has a portion thereof telescoped over the left-hand end of the fusible element 54. Four masses of heat softenable material, such as low melting point alloy, normally mechanically secure and electrically bond those S-shaped connectors to those fusible elements and to the heat absorbers 28 and 34. Portions of one of those masses of heat softenable material are denoted by the numeral 135 in FIG. 8; but the rest of that one mass of heat softenable material cannot be shown completely because it takes the form of a film on a large percentage of the surface of that S-shaped connector. Small portions of the four masses of heat softenable material are shown in FIG. 7; and the other three of those masses of heat softenable material are denoted by the numerals 137,139 and 141. It will be noted that the masses of heat softenable material also electrically bond the bent ends of the fusible elements 50, 52, 54 and 560, respectively, to the projections 58, 60, 62 and 64 on the connecting ring 56. The four masses of heat softenable material and the four S-shaped connectors normally coact to electrically connect the fusible elements 52 and 54 to the heat absorber 30 and normally coact to electrically connect the fusible elements 50 and 560 to the heat absorber 28. Helical extension springs 140, 142 and 144 are secured, respectively, to S-shaped connector 138 and hook 126, to S-shaped connector 136 and hook 132, and to S-shaped connector 134 and hook 130. A fourth helical extension spring, not shown, is connected to the S-shaped connector, not shown, for the fusible element 54 and to hook 128.

The numeral 146 denotes a circular disk of insulating material, such as vulcanized fiber, which is dimensioned to fit snugly within the tubular casing 98. That disk has a generally-rectangular opening 148 therein which is shown particularly by FIG. 7, and which is dimensioned to accommodate the right-hand ends of the offsets 32 and 40, respectively, of the heat absorbers 28 and 34, and also to accommodate the left-hand end of the shunt element 46. In addition, that disk has generally-rectangular slots 150 and 152 therein which accommodate the projections 60 and 62 on the connecting ring 56 and which also accommodate the ends of the fusible elements 52 and 54 which are bent around those projections. Further, the disk 146 has two further generally-rectangular slots, not shown, therein which accommodate the projections 58 and 64 on the connecting ring 56 and also accommodate the ends of the fusible elements 50 and 560 which are bent around those projections.

The left-hand end of the shunt element 46 will be telescoped through the opening 148 in the disk 146, the projection 60 plus the bent end of the fusible element 52 will be telescoped through the opening 150 in that disk, the projection 62 plus the bent end of the fusible element 54 will be telescoped through the opening 152 in that disk, and the projections 58 and 64 plus the bent ends of the fusible elements 50 and 560 will be telescoped through the remaining two openings in that disk 146 prior to the time that shunt element is assembled with the offsets 32 and 40, respectively, of the heat absorbers 28 and 34. Also, prior to the time those offsets are assembled with that shunt element, the right-hand ends of those offsets will be forced apart sufficiently to enable them to accommodate the left-hand end of that shunt element therebetween. Thereafter, the openings in those offsets will be aligned with the opening in the left-hand end of the shunt element 46; and then the rivet 48 will be passed through those aligned openings and "headed" over to permanently secure the heat absorbers 28 and 34 to the shunt element 56 — and hence to the subassembly of which that shunt element is a part.

The numeral 154 denotes a pin which is disposed within the opening 86 in the terminal 84; and the ends of that pin abut the right-hand end of the tubular casing 98. That pin is essentially identical to the pin 104; and the engagements between the ends of those pins and the ends of the tubular casing 98 limit movement of the terminals 84 and 20 inwardly relative to that tubular casing. The numerals 156 and 158 denote semi-circular disks of insulating material, such as asbestos; and those semi-circular disks are identical to the semi-circular disks 100 and 102. The semi-circular disks 100 and 102 closely engage terminal 20, elongated pin 104, and the inner surface of the tubular casing 98; and the semi-circular disks 156 and 158 closely engage terminal 84, elongated pin 154, and the inner surface of the tubular casing 98.

The numeral 160 denotes a ferrule-like closure of metal which has the cylindrical portion thereof telescoped over the left-hand end of the tubular casing 98. The planar wall of that ferrule-like closure has a generally-rectangular slot 162 therein which accommodates the terminal 20. Screws 164 extend radially inwardly through openings in the cylindrical portion of that ferrule-like closure and are seated in the left-hand end of the tubular casing 98. Arcextinguishing filler material 166, such as calcium sulphate, fills the space within the left-hand end of the tubular casing 98 which is defined by the disk 106 and by the semicircular disks 100 and 102. The numeral 170 denotes a similar ferrule-like closure for the right-hand end of the tubular casing 98. The planar wall of that ferrule-like closure has a generally-rectangular slot 172 which accommodates the terminal 84. Screws 174 extend radially inwardly through openings in the cylindrical portion of that ferrule-like closure and are seated in the right-hand end of the tubular casing 98. Arc-extinguishing filler material 176, such as calcium sulphate, fills the space within the rightend of the tubular casing 98 which is defined by the ferrule-like closure 80 and the semi-circular disks 156 and 158. Further arc-extinguishing filler material 178, such as calcium sulphate, fills the annular space between the outer periphery of the tubular casing 92 and the inner periphery of the tubular casing 98.

The fusible element 560 can, and preferably will, be identical to the similarly-numbered fusible element of Aldino J. Gaia application Ser. No. 511,059 for Protector For Electric Circuit which was filed on Oct. 1, 1974. That fusible element has slots 562, 564, 566 and 568 therein; and the slots 564 and 568 are disposed at one side of the longitudinal axis of that fusible element, while the slots 562 and 566 are disposed at the opposite side of that longitudinal axis. The numeral 570 denotes a controlling weak spot which is defined by the right-hand end of the slot 562 and by a generally-triangular notch which extends inwardly from the adjacent edge of the fusible element 560. The numeral 572 denotes a controlling weak spot which is defined by the adjacent ends of the slots 562 and 564; and the numeral 574 denotes a controlling weak spot which is defined by the left-hand end of the slot 564 and by a generaly-triangular notch which extends inwardly from the adjacent edge of the fusible element 560. The numeral 576 denotes a dependent weak spot which is defined by the right-hand end of the slot 562 and by a generally-triangular notch which extends inwardly from the adjacent edge of the fusible element 560; and the numeral 582 denotes a dependent weak spot which is defined by the left-hand end edge of the slot 564 and by a generally-triangular notch which extends inwardly from the adjacent edge of that fusible element. The numerals 578 and 580 denote parts of a two-part dependent weak spot which is defined by the left-hand end of the slot 562 and by the right-hand end of the slot 564 and by generally-triangular notches which extend inwardly from the opposite edges of the fusible element 560.

The numeral 584 denotes a controlling weak spot which is defined by the right-hand end of the slot 566 and by a generally-triangular notch which extends inwardly from the adjacent edge of the fusible element 560. The numeral 586 denotes a controlling weak spot which is defined by the adjacent ends of the slots 566 and 568; and the numeral 588 denotes a controlling weak spot which is defined by the left-hand end of the slot 568 and by a generally-triangular notch which extends inwardly from the adjacent edge of the fusible element 560. The numeral 590 denotes a dependent weak spot which is defined by the right-hand end of the slot 566 and by a generally-triangular notch which extends inwardly from the adjacent edge of the fusible element 560; and the numeral 596 denotes a dependent weak spot which is defined by the left-hand end of the slot 568 and by a generally-triangular notch which extends inwardly from the adjacent edge of that fusible element. The numerals 592 and 594 denote parts of a two-part dependent weak spot which are defined by the left-hand end of the slot 566 and by the right-hand end of the slot 568 and by generally-triangular notches which extend inwardly from the opposite edges of the fusible element 560.

The function and operation of the fusible element 560 can, and preferably will, be identical to the function and operation of the similarly-numbered fusible element in the said Gaia application. Further, the fusible elements 50, 52, and 54 preferably will be identical to the fusible element 560. In addition, the slots and the inwardly-extending notches of the shunt element 46 will be identical in configuration and location to those of the fusible element 560, so that the shape of the current-interrupting characteristic of that shunt element will be substantially identical to the shape of the current-interrupting characteristic of each of the fusible elements 50, 52, 54 and 560. However, the thickness of the shunt element 46 will be less than the thickness of any of the fusible elements 50, 52, 54 and 560; so that shunt element will have a current rating which is less than the current rating of any of those fusible elements. In one fuse of the present invention, which is rated as a six hundred amperes, six hundred volts or less dual element fuse, each of the fusible elements 50, 52, 54 and 560 has a thickness between one hundred and seventy-five and one hundred and eighty ten-thousandths of an inch whereas the shunt element 56 has a thickness between one hundred and thirteen and one hundred and seventeen ten-thousandths of an inch.

Although the current rating of the shunt element 46 is less than the current rating of each of the fusible elements 50, 52, 54 and 560, the current rating of that shunt element is greater than the current rating of each of the connections between the fusible elements and the heat absorbers. Specifically, the softening temperature of the heat-softenable material in the masses of heat softenable material is very much lower than the melting temperature of the copper of the shunt element 56; and hence the masses 135, 137, 139 and 141 of heat softenable material will reach their softening temperature at current values which are considerably below the current values at which that shunt element will fuse.

As long as the value of the current flowing through the dual element fuse of the present invention does not exceed the rating of that dual element fuse, that current will flow through a number of electrical paths between the terminals 20 and 84. One of those electrical paths includes projection 31 of heat absorber 28, includes the portion of that heat absorber which is intermediate that projection and the S-shaped connector 134 which is bonded to that heat absorber and to the fusible element 52 by the mass 139 of heat softenable material, includes that S-shaped connector and that mass of heat softenable material, includes that fusible element, and also includes part of the planar wall of the ferrule-like closure 80. A second of those electrical paths includes projection 30 of the heat absorber 28, includes the portion of that heat absorber which is intermediate that projection and the S-shaped connector, not shown, which is bonded to that heat absorber and to the fusible element 54 by the mass 141 of heat softenable material, includes that S-shaped connector and that mass of heat softenable material, includes that fusible element, and also includes part of the planar wall of the ferrule-like closure 80. A third of those electrical paths includes projection 36 of heat absorber 34, includes the portion of that heat absorber which is intermediate that projection and the S-shaped connector 138 which is bonded to that heat absorber and to the fusible element 50 by the mass 137 of heat softenable material, includes that S-shaped connector and that mass of heat softenable material, includes that fusible element, and also includes part of the planar wall of the ferrule-like closure 80. A fourth of those electrical paths includes projection 38 of heat absorber 34, includes the portion of that heat absorber which is intermediate that projection and the S-shaped connector 136 which is bonded to that heat absorber and to the fusible element 560 by the mass 135 of heat softenable material, includes that S-shaped connector and that mass of heat softenable material, includes that fusible element, and also includes part of the planar wall of the ferrule-like closure 80. A fifth of those electrical paths is a branched electrical path which includes projections 30 and 31 of heat absorber 28 plus projections 36 and 38 of heat absorber 34, includes the portions of those heat absorbers which are intermediate those projection and the offsets 32 and 34, includes those offsets, includes the shunt element 56, and includes part of the planar wall of the ferrule-like closure 80.

The connecting ring 56 is electrically connected to each of the fusible elements 50, 52, 560 and 54 by direct engagement with its projections 58, 60, 64 and 62 and also by the masses 137, 139, 135 and 141 of heat softenable material; and it is connected to each of the S-shaped connectors 138, 134, 136 and the fourth connector, not shown. However, under all normal conditions, little or no current will flow through the planar wall of the connecting ring 56.

Whenever current flows through any of the five electrical paths between the terminals 20 and 84, each portion of each of those electrical paths will respond to the current flowing therethrough to generate heat. Because the electrical resistance of each of the heat absorbers 28 and 34 is very much less than the resistance of any of the fusible elements 50, 52, 54 and 560, only insignificant amounts of heat will be generated by either of those heat absorbers. Because the electrical resistance of each of the connections between those fusible elements and those heat absorbers is much less than the resistance of any of the fusible elements 50, 52, 54 and 560, only relatively small amounts of heat will be generated by each of those connections. However, even the relatively small amounts of heat which are generated by each of the connections between the fusible elements and the heat absorbers are significant; because almost all of the heat that is generated by each of those connections will serve to increase the temperature of the mass of heat softenable material which is part of that connection, and thereby will tend to limit the current ratings of that connection and of the dual element fuse.

The connections between the fusible elements and the heat absorbers of a prior dual element fuse were able to generate relatively small amounts of heat only as long as the electrical resistances of all of those connections were quite low. However, because the dual element fuse of the present invention is equipped with the connecting ring 56, the connections between the fusible elements 50, 52, 54 and 560 and the heat absorbers 28 and 34 could generate relatively small amounts of heat even if one or more of those connections were, somehow, to have a higher-than-normal electrical resistance.

Specifically, if one of the four connections between four fusible elements and one or more heat absorbers of a shunt-equipped prior dual element fuse were, somehow, to have a higher-than-normal electrical resistance, the current through that connection and through the adjacent fusible element would decrease-with a consequent increase in the currents flowing through the shunt and through the other three connections plus the adjacent three fusible elements. Although the reduced current flowing through that one connection and its adjacent fusible element would tend to decrease the amount of heat which was generated by that connection, the higher-than-normal electrical resistance of that connection would tend to increase the amount of heat generated by that connection. Because the current flowing through each connection and its adjacent fusible element is inversely proportional to the sum of the electrical resistances of that connection and fusible element, an increase in the electrical resistance of that connection would not produce a corresponding decrease in that current. Further, because the electrical resistance of that connection is much less than the electrical resistance of that fusible element, the decrease in current through that connection would be so small that the amount of heat generated by the higher-than-normal-electrical-resistance connection would be greater than the amount of heat generated by a normal connection. The overall result is that any increase in the electrical resistance of any one of the four connections between four fusible elements and one or more heat absorbers of a shunt-equipped prior dual element fuse would cause that connection to generate appreciably more heat than would a normal connection-and hence would appreciably reduce the number of seconds during which that dual element fuse could carry an overcurrent of five hundred percent. Contrariwise, if one of the connections between the fusible elements 50, 52, 54 and 560 and the heat absorbers 28 and 34 were to have a higher-than-normal electrical resistance, the amount of heat that was generated by that connection would decrease. Specifically, the connecting ring 56 would permit the current which flows through the fusible element attached to that connection to divide, and thereby flow through the other connections as well as through that connection; and the resulting decrease in the current flowing through that higher-than-normal-electrical-resistance connection would reduce the amount of heat generated by the connection to a value less than the amount of heat generated by a normal connection. The increased current through the other connections of the fuse of FIG. 1 would increase the amount of heat generated by those other connections; but the increase in current in each of those other connections would be smaller than the decrease in current through the higher-than-normal-electrical-resistance connection. Consequently, the amount of heat which could be generated by any of those other connections would be considerably less than the amount of heat which could be generated by a higher-than-normal-electrical-resistance connection in a prior dual element fuse which differed from the fuse of FIG. 1 solely in not having the connecting ring 56. Moreover, any increased amount of heat which would be generated by any of those other connections of the fuse of FIG. 1 would tend to be absorbed or dissipated by the connecting ring 56; and hence that fuse is able, with a higher-than-normal degree of certainty, to carry an overcurrent of five hundred percent for at least ten seconds. As a result, it should be apparent that the connecting ring 56 minimizes the effect which a higher-than-normal resistance of a connection between the left-hand end of any one of the fusible elements 50, 52, 54 and 560 and the adjacent heat absorber could have on the overall operation of the fuse of FIG. 1.

The cylindrical portion 66 of the connecting ring 56 is immediately adjacent the inner surface of the casing 98; and hence it can transfer appreciable amounts of heat to that casing. This is desirable; because it enables that connecting ring to act as a heat absorber, and thereby helps reduce the rate at which the temperatures of the masses 135, 137, 139 and 141 of heat softenable material will rise in response to overcurrents.

The upper portions of the S-shaped connectors of the fuse of FIG. 1 are made considerably thicker than the upper portions of the S-shaped connectors of prior dual element fuses of the same ampere rating. That extra thickness enables the upper portion, of whichever S-shaped connector happens to be the last S-shaped connector to respond to a long continued relatively-low, potentially-hurtful overcurrent move away from its adjacent fusible element, to withstand the heavy current which will pass through that upper portion.

The space or gap which is defined by the upper portion of each of the S-shaped connectors of the fuse of FIG. 1 is larger than the space or gap which is defined by the upper portion of an S-shaped connector for a prior dual element fuse; because the combined thicknesses of the re-entrant bent end of a fusible element and of the projection around which it is bent are much greater than the thickness of a fusible element of a prior dual element fuse of the same ampere rating. However, the manufacturing tolerance of the space or gap which is defined by the upper portion of each of the S-shaped connectors of FIG. 1 can be much smaller than the manufacturing tolerance of the space or gap which is defined by the upper portion of any S-shaped connector for a prior dual element fuse; because the projections 58, 60, 62 and 64 of the connecting ring 56 precisely fix both the attitudes and positions of the re-entrant bent ends of the fusible elements 50, 52, 54 and 560. The closer manufacturing tolerance of the space or gap which is defined by the upper portion of each of the S-shaped connectors of the fuse of FIG. 1 would permit the amount of heat softenable material, between the re-entrant bent end of a fusible element and the confronting surfaces of the adjacent S-shaped connector, to be reduced—with a corresponding reduction in the electrical resistance of the connection of which that S-shaped connector is a part.

The connecting ring 56 and the ferrule-like closure 80 connect the fusible elements 50, 52, 54 and 560 in parallel relation with each other; and hence the currents flowing through, and the amounts of heat generated by, those fusible elements will be substantially equal. Because the shunt element 46 is thinner than any of the fusible elements 50, 52, 54 and 560, the current flowing through, and the amount of heat generated by, that shunt element will be less than the current flowing through, and the amount of heat generated by, any of the fusible elements 50, 52, 54 and 560.

The thicknesses of the fusible elements 50, 52, 54 and 560 are selected so those fusible elements will generate enough heat to enable the masses 137, 139, 141 and 135 of heat softenable material to soften in less than two hours whenever the fuse of FIG. 1 is subjected to an overcurrent of one hundred and thirty-five percent. Also, those thicknesses are selected so those masses of heat softenable material will not soften in less than ten seconds whenever the fuse of FIG. 1 is subjected to an overcurrent of five hundred percent. However, the thicknesses of the fusible elements 50, 52, 56 and 560 are selected so those fusible elements will promptly and safely fuse on overcurrents greater than five hundred percent and on short circuits.

As long as the current flowing through the dual element fuse of the present invention does not exceed the rating of that fuse, the masses 135, 137, 139 and 141 of heat softenable material will not soften and the fusible elements 50, 52, 54 and 560 will not fuse; and hence the shunt element 46 will remain intact. If an overcurrent in the range of one hundred and thirty five percent to four hundred percent develops and continues for a sufficiently long time, the masses 135, 137, 139 and 141 of heat softenable material will soften and the helical extension springs 140, 142, 144 and the fourth helical extension spring, not shown, will pull the S-shaped connectors 138, 136 and 134 and the fourth S-shaped connector, not shown, away from the left-hand ends of the fusible elements 50, 560, 52 and 54, respectively. Thereupon, all of the current flowing through the fuse of FIG. 1 will pass through the shunt element 46; and, immediately, that shunt element will fuse. That shunt element will operate in the manner in which the fusible element 560 of the said Gaia application will fuse to open the circuit; and the arcs which will form as that shunt element opens the circuit will quickly be quenched by the arc-quenching filler material 93 within the casing 92.

In the event an overcurrent substantially greater than five hundred percent or a short circuit develops, the shunt element 46 will promptly fuse; and the fusible elements 50, 52, 54 and 560 will, either simultaneously with or immediately after the fusing of that shunt element, fuse to open the circuit. Because the shape of the current-interrupting characteristic of the shunt element is substantially identical to the shape of the current-interrupting characteristic of each of the fusible elements, the clearing time of the fuse of FIG. 1 is substantially as short as the clearing time of any one of those fusible elements. Further, because the shunt element and the fusible elements are embedded within the large mass of arc-quenching filler material 93 within the casing 92, the clearing actions of that shunt element and of those fusible elements are rapid and quiet. The fusible elements 50, 52, 54 and 560 and the shunt element 46 will fuse in the same manner as, and as effectively as, the fusible element 560 of the said Gaia application fuses.

In the event an overcurrent in the range of four hundred to five hundred percent develops, the masses 135, 137, 139 and 141 of heat softenable material may soften and release the S-shaped connectors before the fusible elements 50, 52, 54 and 560 fuse, or those fusible elements could fuse before those masses of heat softenable material could soften. In the former instance, the shunt element 46 would open the circuit after the S-shaped connectors had been released; and in the latter instance, that shunt element would fuse immediately before, or simultaneously with, the fusible elements 50, 52, 54 and 560. In all instances, the only arcs which could develop would develop in, and be rapidly and safely extinguished by, the arc-quenching filler material 93 within the casing 92.

The shunt element 46 and each of the fusible elements 50, 52, 54 and 560 are straight throughout the heat-generating portions of the lengths thereof; and those heat-generating portions incorporate therein all of the slots and notches of that shunt element and of those fusible elements. The heat-generating portions of the shunt element and of the fusible elements are contacted and surrounded by the arc-quenching filler material 93. The full-width left-hand ends of the shunt element and of the fusible elements extend through and beyond the left-hand end of the casing 92; but the full-width left-hand end of the shunt element is directly connected to both heat absorbers whereas the full-width left-hand end of each fusible element is connected to just one of the heat absorbers by an S-shaped connector and the appropriate mass of heat softenable material.

If desired, a large mass of heat softenable material could be substituted for the four S-shaped connectors and four masses of heat softenable material. That large mass of heat softenable material would respond to long continued, relatively low, potentially-hurtful overcurrents to melt and flow away from the bent ends of the fusible elements 50, 52, 54 and 560. Thereafter, the shunt element 46 would fuse to open the circuit.

The fuse of FIG. 1 is a dual element fuse which has an ampere rating of six hundred amperes and a voltage rating up to six hundred volts. For fuses which had a smaller ampere rating, fewer fusible elements and fewer S-shaped connectors could be used. For some dual element fuses, just one heat absorber could be used.

The connecting ring 56 is very useful in the fuse of FIG. 1; but it would be useful in other dual element fuses as well. In fact, that connecting ring would be useful in a dual element fuse that was not equipped with a shunt element. In those fuses, as well as in the fuse of FIG. 1, the connecting ring would act to absorb heat from the connections between the fusible elements and the adjacent heat absorbers, and also would fix the positions and attitudes of those ends of the fusible elements which constitute parts of those connections.

Because the shunt element 46 is made so the shape of the current-interrupting characteristic thereof is substantially the same as the shape of the current-interrupting characteristic of each of the fusible elements 50, 52, 54 and 560, that shunt element can be dimensioned to carry proportionately more current than could any shunt of a prior dual element fuse. This is desirable, because it reduces the amount of current which must flow through the four connections between those fusible elements and the two heat absorbers, and it thereby reduces the amount of heat which will be generated by those connections. All of this means that the shunt element 46 of the fuse of FIG. 1 not only enables that fuse to have a desirable clearing action but it also enables that fuse to carry a five hundred percent overcurrent for appreciably more than ten seconds.

The re-entrant bent ends of the fusible elements 50, 52, 54 and 560 are desirable because they space the punched ends of those fusible elements away from the gaps or spaces which are defined by the upper portions of the S-shaped connectors. Those re-entrant bent ends also are desirable because they increase the area of engagement between the fusible elements and the masses of heat softenable material—with consequent reductions in the electrical resistances between those fusible elements and those S-shaped connectors.

The fact that the shape of the current-interrupting characteristic of the shunt element is substantially identical to the shape of the current-interrupting characteristic of each of the fusible elements is important. In the first place, it provides a very short clearing time for the fuse of FIG. 1. Further, it facilitates more precise testing of that fuse at various established test conditions. Additionally, it facilitates extrapolation of test data, obtained at various established test conditions, for all other possible conditions of loads and overcurrents which could be met in the field.

The notches and slots of the shunt element 46 define more than one electrical path and, similarly, the notches and slots of each of the fusible elements 50, 52, 54 and 560 define more than one electrical path. The peak current ($I_p$) and energy ($I^2t$) of each electrical path in the shunt element 46 are, respectively, two hundred percent or less of the peak current ($I_p$) and energy ($I^2t$) of each electrical path in each of the fusible elements 50, 52, 54 and 560 when that shunt element and those fusible elements are tested at the interrupting rating of the dual-element fuse of FIG. 1. Further, that dual-element fuse has a lower peak current ($I_p$) and lower energy ($I^2t$) than any prior shunt-equipped dual element fuse of the same rating. All of this means that the fuse of FIG. 1 can be made smaller in size, can be made with lighter-strength casings and ferrule-like closures, or can have a current-interrupting capability which is even greater than the presently-established standard current-interrupting capability of two hundred thousand amperes, and yet maintain $I^2t$ and $I_p$ values which are presently felt to be adequate.

The fuse of FIG. 1 embeds the heat-generating portion of the shunt element 46 within the same larger mass of arc-quenching filler material 93 in which the heat-generating portions of the fusible elements 50, 52, 54 and 560 are embedded. As a result, the present invention eliminates all need of a special insulating sheath or separate casing for the shunt element, and also obviates the need of locating that shunt element close to the inner surface of the fuse casing. In fact, the shunt element and the fusible elements of the fuse of FIG. 1, and of any larger or smaller dual element fuse using such a shunt element, could be arranged in any desired pattern or relative disposition to facilitate the most desirable assembly procedures or to provide the most desirable circuit-opening action.

Prior shunt-equipped dual element fuses have utilized wire-like shunts. For example, in said A. J. Fister U.S. Pat. No. 3,122,619 a wire-like shunt extended from one knife blade terminal to the heat-absorbing member, in A. J. Fister U.S. Pat. No. 3,253,103 which was granted May 24, 1966 a wire-like shunt extended from one knife blade terminal to the other knife blade terminal, and in J. S. Withers U.S. Pat. No. 3,453,580 which was granted July 1, 1969 a two-piece wire-like shunt that had two reduced-diameter portions extended from one terminal to the heat-absorbing element. Because the shunts of those patents were wire-like, the current-interrupting characteristics of those shunts were distinctively different from the current-interrupting characteristics of the fusible elements of those patents. Further, to enable the clearing times of those wire-like shunts to be sufficiently short to avoid undue prolongations of the clearing times of the fuses of those patents, the maximum current carrying capacity of each of those shunts was made quite small relative to the maximum current carrying capacity of the fuse, of which it was a part, when that shunt and that fuse were tested at the current-interrupting rating of that fuse. By using the shunt provided by the present invention, it is possible to make the maximum current carrying capacity of that shunt higher than the maximum current carrying capacity which was deemed to be desirable for the shunts in correspondingly-rated fuses in said Fister and Withers patents, and yet not have the clearing time of that shunt prolong the clearing time of the fuse of FIG. 1 when that shunt and that fuse are tested at the current interrupting rating of that fuse. By having an increased maximum current carrying capacity, the shunt of the present invention makes it possible to reduce the current-interrupting duty of each of the fusible elements of the fuse of FIG. 1.

The maximum current carrying capacity of the shunt element 46 should be less than forty percent of the maximum current carrying capacity of the overall shunt-equipped dual-element fuse of FIG. 1, so that shunt element will fuse whenever the S-shaped connectors of that dual-element fuse are released. However, the maximum current carrying capacity of the shunt element 46 should be equal to or greater than fifteen percent of the maximum current carrying capacity of the overall shunt-equipped dual-element fuse of FIG. 1, and it should be one hundred and twenty percent or less of the maximum current carrying capacity of each of the fusible elements 50, 52, 54 and 560.

The shunt element 46 and the fusible elements 50, 52, 54 and 560 could be made from copper, high-conductivity copper alloys, silver or high conductivity silver alloys. That shunt element could be made from the same metal or alloy from which those fusible elements are made.

The fusible elements 50, 52, 54 and 560 can be made flat throughout the effective portions of the lengths thereof, as shown by the drawing, or they could be folded or bent or bowed as shown in said A. J. Fister U.S. Pat. No. 3,253,103 or in said J. S. Withers patent or in said Gaia application. Moreover, if desired, some of the fusible elements 50, 52, 54 and 560 could be made flat throughout the effective portions of the lengths thereof, as shown by the drawing, and the rest of those fusible elements could be folded or bent or bowed as shown in said A. J. Fister U.S. Pat. No. 3,253,103 or in said J. S. Withers patent or in said Gaia application.

Whereas the drawing and accompanying description have shown and described a preferred form of the present invention it should be apparent to those skilled in the art that various changes may be made in the form of the invention without affecting the scope thereof.

What I claim is:

1. An electric fuse that comprises terminals, a first electrical path between said terminals which has a predetermined current rating and a predetermined current-interrupting characteristic and which includes a fusible element, and a second electrical path between said terminals which is connected in shunting relation with at least part of said first electrical path and which includes a shunt element, said fusible element having at least one fusible electrical path therein which has a predetermined peak current ($I_p$) and energy ($I^2t$), said shunt element having at least one fusible electrical path therein which has a given peak current ($I_p$) and energy ($I^2t$), said peak current ($I_p$) and energy ($I^2t$) of said fusible electrical path in said shunt element being, respectively, two hundred percent or less of said peak current ($I_p$) and energy ($I^2t$) of said fusible electrical path in said fusible element when said shunt element and said fusible elements are tested at the current-interrupting rating of said electric fuse, said first electrical path responding to a long-continued potentially-hurtful relatively-low overcurrent to electrically disconnect said fusible element from at least one of said terminals, said second electrical path thereafter responding to said long-continued potentially-hurtful relatively-low overcurrent to open the circuit in which said electric fuse is connected, both said fusible electrical paths in said fusible element and in said shunt element responding to a short circuit to help open said circuit.

2. An electric fuse as claimed in claim 1 wherein said first electrical path includes heat softenable material that normally electrically connects said fusible element to one of said terminals but that can respond to heat to permit said fusible element to become disconnected from said one of said terminals, wherein said fusible element is disposed within a chamber, wherein said shunt element also is disposed within said chamber, wherein arc-extinguishing filler is disposed within said chamber in engagement with said fusible element and also in engagement with said shunt element, wherein said heat-softenable material is disposed within a second chamber which is adjacent the first said chamber, and wherein one end of said fusible element and one end of said shunt element extend through the same end of said first said chamber and into said second chamber.

3. An electric fuse as claimed in claim 1 wherein said fusible element is disposed within a chamber, wherein said shunt element also is disposed within said chamber, wherein said fusible element and said shunt element are substantially straight, and wherein one end of said fusible element and one end of said shunt element extend through the same end of said chamber and into an adjacent chamber.

4. An electric fuse as claimed in claim 1 wherein said first electrical path includes means that can respond to a long-continued potentially-hurtful relatively-low overcurrent to electrically disconnect said fusible element from at least one of said terminals, wherein said means primarily determines said current rating of said first electrical path, and wherein said shunt element is connected in shunting relation with at least a part of said means to make said current rating of said second electrical path appreciably different from said current rating of said first electrical path.

5. An electric fuse as claimed in claim 1 wherein said shunt element has a plurality of longitudinally-spaced weak spots therein, and wherein the current rating of said shunt element is smaller than said predetermined current rating.

6. An electric fuse as claimed in claim 1 wherein said first electrical path includes heat-softenable material that normally electrically connects said fusible element to one of said terminals but that can respond to heat to permit said fusible element to become disconnected from said one of said terminals, and wherein the current rating of said shunt element is larger than said predetermined current rating but is smaller than the current rating of said fusible element.

7. An electric fuse as claimed in claim 1 wherein said first electrical path includes heat-softenable material that can respond to said long-continued potentially-hurtful relatively-low overcurrent to soften and thereby permit said first electrical path to become open, and wherein said shunt element will subsequently respond to the opening of said first electrical path to fuse and thereby open said second electrical path.

8. An electric fuse as claimed in claim 1 wherein said first electrical path includes a heat-absorbing member and also includes heat softenable material which can respond to said long-continued potentially-hurtful relatively-low overcurrent to soften and thereby permit said first electrical path to become open, and wherein said second electrical path also includes said heat-absorbing member.

9. An electrical fuse as claimed in claim 1 wherein said fusible element is made from a material in the group consisting of copper, high conductivity copper alloys, silver and high conductivity silver alloys, and wherein said shunt element also is made from a material in the group consisting of copper, high conductivity copper alloys, silver and high conductivity silver alloys.

10. An electric fuse as claimed in claim 1 wherein said shunt element is made from a high conductivity material, and wherein said fusible element also is made from a high conductivity material.

11. An electric fuse that comprises terminals, a first electrical path between said terminals which has a predetermined current rating and a predetermined current-interrupting characteristic and which includes a fusible element, a second electrical path between said terminals which is connected in shunting relation with at least part of said first electrical path and which includes a shunt element, said fusible element having at least one fusible electrical path therein which has a predetermined peak current ($I_p$) and energy ($I^2t$), said shunt element having at least one fusible electrical path therein which has a given peak current ($I_p$) and energy ($I^2t$), said peak current ($I_p$) and energy ($I^2t$) of said fusible electrical path in said shunt element being, respectively, two hundred percent or less of said peak current ($I_p$) and energy ($I^2t$) of said fusible electrical path in said fusible element when said shunt element and said fusible elements are tested at the current-interrupting rating of said electric fuse, said first electrical path responding to a long-continued potentially-hurtful relatively-low overcurrent to electrically disconnect said fusible element from at least one of said terminals, said second electrical path thereafter responding to said long-continued potentially-hurtful relatively-low overcurrent to open the circuit in which said electric fuse is connected, both said fusible electrical paths in said fusible element and in said shunt element responding to a short circuit to help open said circuit said fusible element being disposed within a chamber, said shunt element also being disposed within said chamber, and arc-extinguishing filler being disposed within said chamber in engagement with said fusible element and also in engagement with said shunt element.

12. An electric fuse that comprises terminals, a first electrical path between said terminals which has a predetermined current rating and a predetermined current-interrupting characteristic and which includes a fusible element, a second electrical path between said terminals which is connected in shunting relation with at least part of said first electrical path and which includes a shunt element, said fusible element having at least one fusible electrical path therein which has a predetermined peak current ($I_p$) and energy ($I^2t$), said shunt element having at least one fusible electrical path therein which has a given peak current ($I_p$) and energy ($I^2t$), said peak current ($I_p$) and energy ($I^2t$) of said fusible electrical path in said shunt element being, respectively, two hundred percent or less of said peak current ($I_p$) and energy ($I^2t$) of said fusible electrical path in said fusible element when said shunt element and said fusible elements are tested at the current-interrupting rating of said electric fuse, said first electrical path responding to a long-continued potentially-hurtful relatively-low overcurrent to electrically disconnect said fusible element from at least one of said terminals, said second electrical path thereafter responding to said long-continued potentially-hurtful relatively-low overcurrent to open the circuit in which said electric fuse is connected, both said fusible electrical paths in said fusible element and in said shunt element responding to a short circuit to help open said circuit, said fusible element being disposed within a chamber, said shunt element also being disposed within said chamber, said first electrical path including means that can respond to a long-continued potentially-hurtful relatively-low overcurrent to electrically disconnect said fusible element from at least one of said terminals, said means being disposed within an adjacent chamber, one end of said fusible element and one end of said shunt element extending through the same end of the first said chamber and into said adjacent chamber, arc-extinguishing filler being disposed within the first said chamber, and said one end of said fusible element being connected in series relation with said means within said adjacent chamber but said one end of said shunt element being connected in shunting relation with a portion of said means and in series relation with a further portion of said means.

13. An electric fuse that comprises terminals, a first electrical path between said terminals which has a predetermined current rating and a predetermined current-interrupting characteristic and which includes a fusible element, a second electrical path between said terminals which is connected in shunting relation with at least part of said first electrical path and which includes a shunt element, said fusible element having at least one fusible electrical path therein which has a predetermined peak current ($I_p$) and energy ($I^2t$), said shunt element having at least one fusible electrical path therein which has a given peak current ($I_p$) and energy ($I^2t$), said peak current ($I_p$) and energy ($I^2t$) of said fusible electrical path in said shunt element being, respectively, two hundred percent or less of said peak current ($I_p$) and energy ($I^2t$) of said fusible electrical path in said fusible element when said shunt element and said fusible elements are tested at the current-interrupting rating of said electric fuse, said first electrical path responding to a long-continued potentially-hurtful relatively-low overcurrent to electrically disconnect said fusible element from at least one of said terminals, said second electrical path thereafter responding to said long-continued potentially-hurtful relatively-low overcurrent to open the circuit in which said electric fuse is connected, both said fusible electrical paths in said fusible element and in said shunt element responding to a short circuit to help open said circuit, said fusible element having a plurality of weak spots therein of a given configuration, said shunt element having a corresponding plurality of weak spots therein of substantially the same configuration, and the thickness of said shunt element being less than the thickness of said fusible element.

14. An electric fuse that comprises terminals, a fusible element which has a predetermined current-interrupting characteristic, means connecting said fusible element between said terminals and coacting with said fusible element to help form a first electrical path which interconnects said terminals, said means and said fusible element coacting to provide a predetermined current rating and a predetermined current-interrupting characteristic for said electrical path, said predetermined current-interrupting characteristic for said first electrical path being determined primarily by said current-interrupting characteristic of said fusible element at all levels of current at which said fusible element initiates opening of said first electrical path, a shunt element having a current-interrupting characteristic which has substantially the same shape as said predetermined current-interrupting characteristic of said fusible element, means, which differs at least in part from the first said means, connecting said shunt element between said terminals and coacting with said shunt element to form a second electrical path which interconnects said terminals, the second said means and said shunt element coacting to provide a current rating for said second electrical path which is appreciably different from said predetermined current rating while also coacting to provide a current-interrupting characteristic which has substantially the same shape as said predetermined current-interrupting characteristic for said first electrical path at all levels of current at which said fusible element initiates opening of said first electrical path, said first electrical path responding to a long-continued potentially-hurtful relatively-low overcurrent to electrically disconnect said fusible element from at least one of said terminals, said second electrical path thereafter responding to said long-continued potentially-hurtful relatively-low overcurrent to open the circuit, both said first and said second electrical paths responding to a short circuit to cause said fusible element and said shunt element to fuse and thereby open the circuit.

15. An electric fuse that comprises terminals, a first electrical path between said terminals which has a predetermined current rating and a predetermined current-interrupting characteristic and which includes a fusible element, and a second electrical path between said terminals which is connected in shunting relation with at least part of said first electrical path, said second electrical path having a current rating which is appreciably different from said current rating of said first electrical path but having a current-interrupting characteristic which has substantially the same shape as said predetermined current-interrupting characteristic at all levels of current at which said fusible element initiates opening of said first electrical path, said first electrical path responding to a long-continued potentially-hurtful relatively-low overcurrent to electrically disconnect said fusible element from at least one of said terminals, said second electrical path thereafter responding to said long-continued potentially-hurtful relatively-low overcurrent to open the circuit in which said electric fuse is connected, both said first and said second electrical paths responding to a short circuit to open said circuit.

* * * * *

UNITED STATES PATENT AND TRADEMARK OFFICE

CERTIFICATE OF CORRECTION

PATENT NO. : 4,058,786

DATED : November 15, 1977

INVENTOR(S) : Aldino J. Gaia & Angelo Urani

It is certified that error appears in the above-identified patent and that said Letters Patent are hereby corrected as shown below:

Column 19, line 2, before "electrical" add -first-

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*